US006113219A

United States Patent [19]

Mizoguchi et al.

[11] Patent Number: 6,113,219

[45] Date of Patent: Sep. 5, 2000

[54] ELECTROSTATIC INK JET RECORDING APPARATUS CAPABLE OF REALIZING STABLE EJECTION OF INK

[75] Inventors: Tadashi Mizoguchi; Hitoshi Takemoto; Junichi Suetsugu; Hitoshi Minemoto; Kazuo Shima; Yoshihiro Hagiwara; Ryosuke Uematsu; Toru Yakushiji, all of Niigata, Japan

[73] Assignee: NEC Corporation, Tokyo, Japan

[21] Appl. No.: 08/917,769

[22] Filed: Aug. 27, 1997

[30] Foreign Application Priority Data

Aug. 28, 1996 [JP] Japan ..... 8-227115
Aug. 28, 1996 [JP] Japan ..... 8-227116

[51] Int. Cl.[7] ..... B41J 2/06

[52] U.S. Cl. ..... 347/55

[58] Field of Search ..... 347/55, 141, 103, 347/154, 151, 120, 10, 11, 143, 144; 399/392, 293, 295, 271, 290, 294, 292

[56] References Cited

FOREIGN PATENT DOCUMENTS

0703080 A2 3/1996 European Pat. Off. ..... 347/55
56-127461 10/1981 Japan .
62-124567 6/1987 Japan .
WO 93/11866 6/1993 WIPO .

*Primary Examiner*—John Barlow
*Assistant Examiner*—Raquel Yvette Gordon
*Attorney, Agent, or Firm*—Whitham, Curtis & Whitham

[57] ABSTRACT

A recording head includes an ink chamber storing ink containing electrified toner particles and having an ejection opening 7 at one end and an ejection electrodes for ejecting the toner particles from the ejection opening. A counter electrode 6 faces the ejection opening. The recording head also includes a toner, concentration detection sensor detects a potential of the ejection opening 7, and a control unit for deciding a detected toner concentration and controlling a voltage to be applied to the ejection electrodes. The surface potential nearby ejection opening or the toner concentration and a voltage applying time are made to previously correspond to each other and are stored in a ROM table. A stable printing quality is obtained by detecting the toner concentration near the ejection opening by the toner concentration detection circuit and controlling a voltage to be applied to the ejection electrodes corresponding to a detected value.

14 Claims, 7 Drawing Sheets

ROM TABLE 20

| VALUE OF A-D CONVERTER | PULSE HEIGHT | PULSE WIDTH | PULSE FREQUENCY |
|---|---|---|---|
| 0 | | | |
| 1 | | | |
| 2 | | | |
| ⋮ | ⋮ | ⋮ | ⋮ |
| 15 | | | |

ELECTROSTATIC INK JET RECORDING APPARATUS CAPABLE OF REALIZING STABLE EJECTION OF INK

BACKGROUND OF THE INVENTION

1. Field of the Invention

The present invention relates to an electrostatic ink-jet recording apparatus, and more particularly to an electrostatic ink-jet recording apparatus for recording data by using an ink obtained by dispersing toner particles in a carrier solution and thereby ejecting the toner particles in accordance with an electrostatic force.

2. Description of the Prior Art

As described in PCT Publication Number WO93/11866, a conventional electrostatic ink-jet recording apparatus comprises an electrostatic ink-jet recording head and a counter electrode set at the back of a recording paper to form an electric field between the counter electrode and the ink-jet recording head. The ink-jet recording head has an ink chamber for temporarily storing an ink solution supplied from an ink tank or the like. An ejection electrode is formed at an end of the ink chamber and driven to eject the ink. The front end of the ejection electrode faces the counter electrode. The ink solution in the ink chamber is supplied up to the front end of the ejection electrode due to the surface tension of the ink solution and thereby, ink meniscuses are formed at the front end of the ejection electrode.

The ink solution used for the ink-jet recording head contains electrified toner particles for producing a color. The electrified toner particles are electrified into the positive polarity due to a zeta potential. However, while no voltage is applied to the ejection electrode, the ink solution is electrically kept neutral. The polarity of the zeta potential is determined by the characteristic of the electrified particle substance.

When a voltage having the positive polarity is applied to the ejection electrode, the positive-polarity potential of the ink solution is raised. In this case, the electrified toner particles are moved to the front end of the ejection electrode through the ink solution due to the electric field working between the ejection electrode and the counter electrode. The electrified toner particle particles moved up to the front end of the ejection electrode are strongly attracted to the counter electrode side due to the electric field working between the front end of the ejection electrode and the counter electrode. When the Coulomb force working between the electrified toner particles present at the front end of the ejection electrode and the counter electrode greatly exceed the surface tension of the ink solution, agglomerations of the electrified toner particles having a small amount of liquid fly from the front end of the ejection electrode toward the counter electrode and attach to the surface of a recording medium. Thus, by applying a voltage to the ejection electrode, the agglomerations of the electrified particle substance successively fly from the front end of the ejection electrode and printing is executed.

Next, such a kind of conventional electrostatic ink-jet recording apparatus is explained hereunder.

In FIG. 7, the surface of a substrate 54 of an ink-jet recording head 53 is covered with an upper cover 53*a* and a lower cover 53*b*, and a slitted ejection opening 57 for holding ink 14 faces toward a counter electrode 56. Moreover, a plurality of ejection electrodes 54*a* are printed on the surface of the substrate 54 along the ink jet direction in parallel. These electrodes 54*a* are connected to a not-illustrated voltage driving section so that high-voltage pulses are selectively applied to the ejection electrodes 54*a* at the time of recording. Furthermore, counter electrode 56 is arranged on the extension line of the ejection electrodes 54*a* through recording medium 58 to generate an electric field between the counter electrode 56 and the ejection electrodes 54*a* at the time of recording. In this case, because the ejection electrodes 54*a* are acicular, an electric field is concentrated on the tip of the ejection electrodes 54*a* at the time of recording and electric charges are accumulated in the ink 14 nearby the ejection electrodes 54*a*.

For the toner particles to fly, the toner potential of the ejection electrodes 54*a* must rise up to a potential high enough for the toner particles to fly. When the toner particles potential exceeds an ejection potential capable of ejecting the toner particles, the toner particles fly toward the counter electrode 56.

However, the toner particle potential fluctuates in the time until reaching the ejectable potential because a characteristic of the ink 14 such as toner concentration fluctuates. This causes a problem that ejection of toner particles having been ejected by applying a voltage to the ejection electrodes 54*a* for a predetermined time is stopped due to the fluctuation of the ink characteristic.

For example, ejection of toner particles is stopped when the potential of the toner particles does not reach the ejectable potential during a predetermined time for applying the ejecting voltage. However, when a time until reaching the ejectable potential becomes too short in comparison with the predetermined time, a problem occurs that, though toner particles can be ejected for shorter time, the amount of toner particles to be ejected increases because a voltage is excessively applied and thus, the dot diameter increases on a recording medium.

SUMMARY OF THE INVENTION

It is an object of the present invention to provide an electrostatic ink-jet recording apparatus for realizing stable printing by realizing stable ejection of toner correspondingly to the change of ink characteristics and thereby, widening the allowable range of the ink characteristic.

An electrostatic ink-jet recording apparatus of the present invention includes an ink chamber storing ink containing electrified toner particles and having an ejection opening at one end, an ejection electrode for ejecting the toner particles from the ejection opening, and a counter electrode faced with the ejection opening through a recording medium. Further, a toner concentration detection element for detecting the potential of the ejection opening and a control circuit for controlling a voltage to be applied to the ejection electrode in accordance with the detected potential are included.

Since, according to this construction, it is possible to keep diameter of ink droplet identically independent of toner concentration in ink.

Moreover, an electrostatic ink-jet recording apparatus of the present invention includes an ink chamber storing ink containing electrified toner particles and having an ejection opening at one end, an ejection electrode for ejecting the toner particles form the ejection opening, and a counter electrode faced with the ejection opening. Further, a toner concentration measurement device for measuring the toner particle concentration in the ink and a control circuit for controlling a voltage to be applied to the ejection electrode in accordance with the toner particle concentration are included.

Since, according to this construction, it is possible to keep diameter of ink droplet identically independent of toner concentration in ink.

DETAILED DESCRIPTION OF THE PREFERRED EMBODIMENTS

Figure 1:
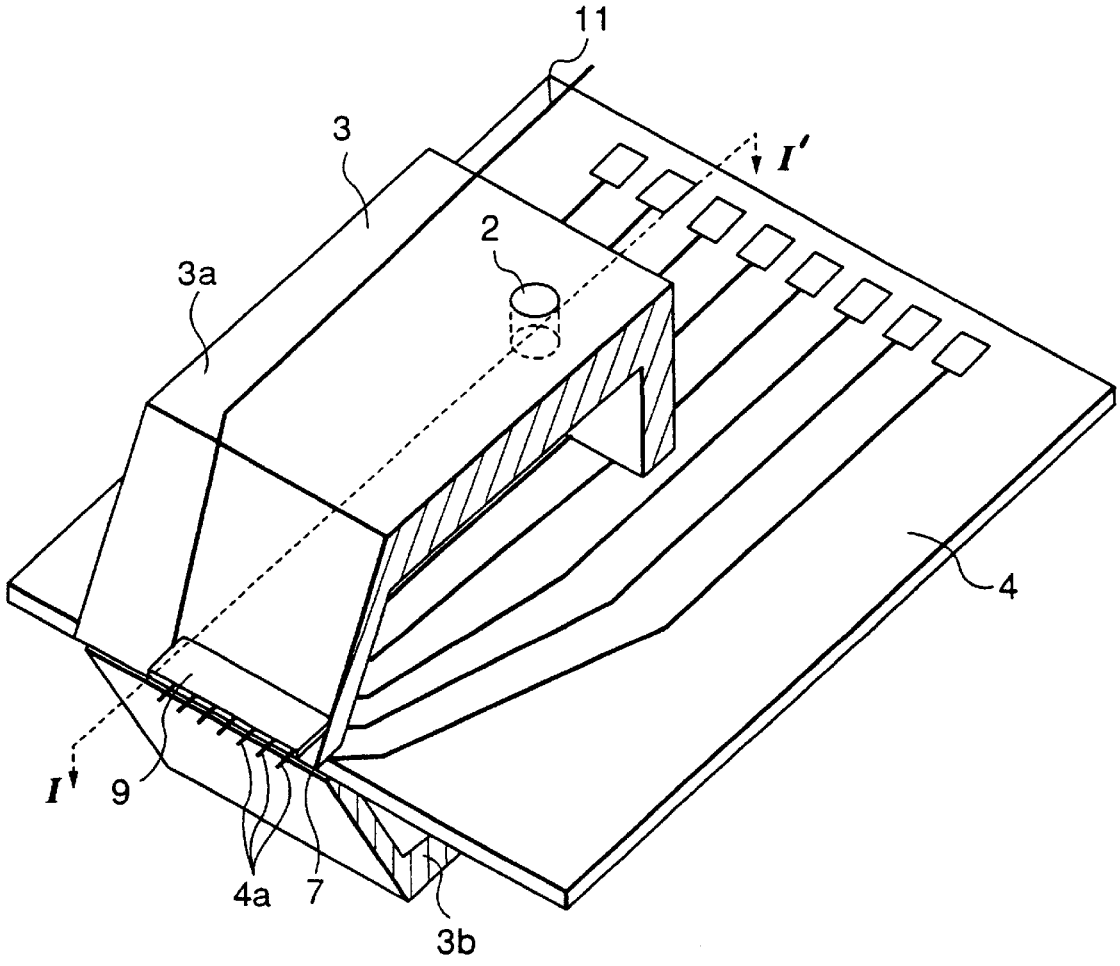
FIG. 1 is a partial sectional perspective view showing a part of the embodiment of the present invention.
Figure 2:
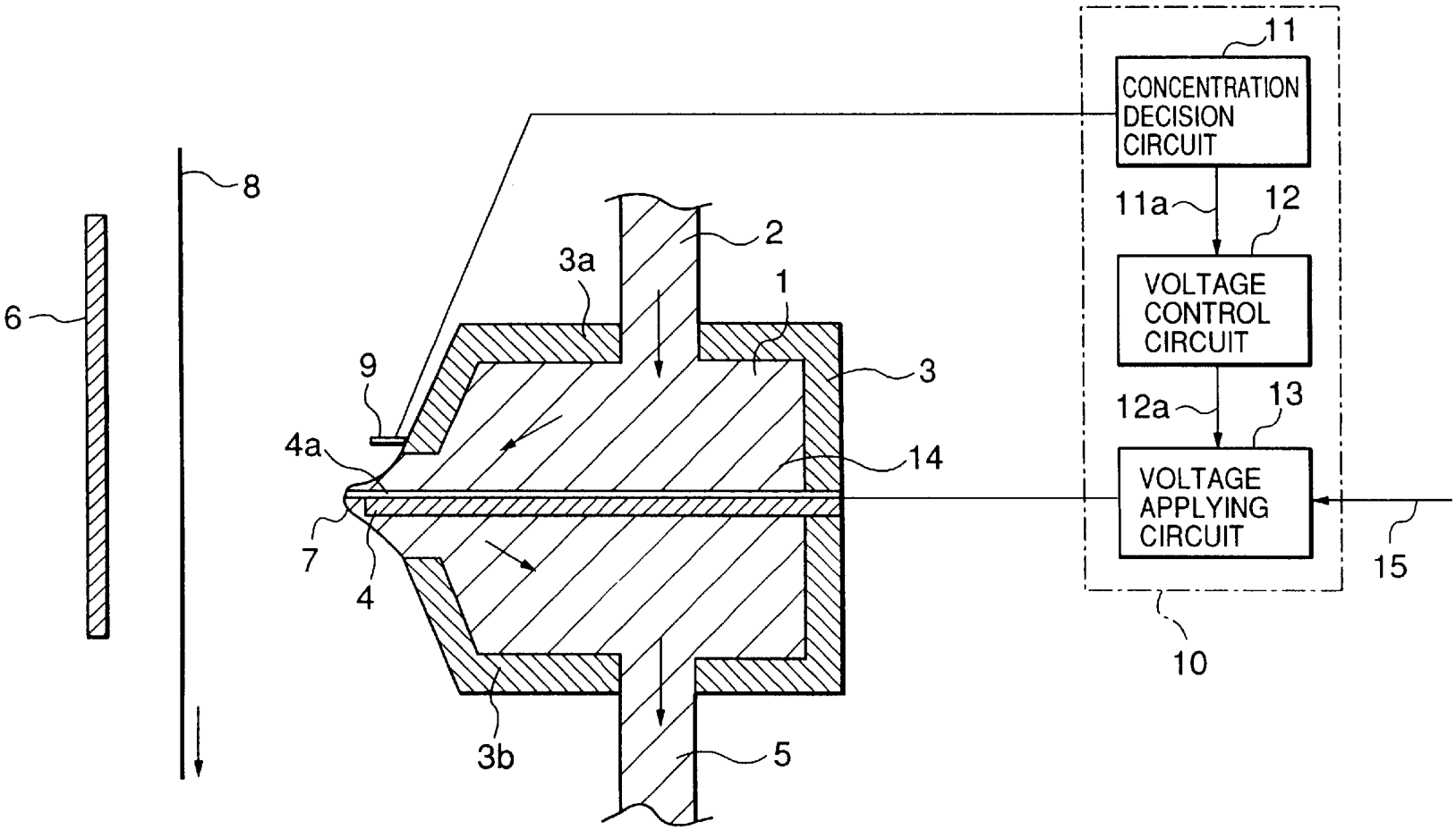
FIG. 2 is a block diagram and an A—A sectional view showing an embodiment of the embodiment in FIG. 1.

The electrostatic ink-jet recording apparatus shown in FIGS. 1 and 2 has a recording head 3 having an upper cover 3*a* and a lower cover 3*b* and provided with an ink chamber 1 storing ink 14 containing electrified toner particles and having an ejection opening 7 at one end. A counter electrode 6 faces with the ejection opening 7 through a recording medium 8. A toner concentration detection element 9 detects electrical potential of the ejection opening 7. A control unit 10 is provided with a concentration decision circuit 11 for deciding the detected electrical potential. The control unit 10 is further provided with a voltage control circuit 12 for controlling a voltage output to be applied to a plurality of ejection electrodes 4*a* respectively printed on upper surface of substrate 4 in accordance with the decision by the concentration decision section 11, and a voltage applying circuit 13 for applying a voltage to the ejection electrodes 4*a* in accordance with the output of the voltage control circuit 12.

The ink chamber 1 of the recording head 3 is filled with the ink 14. The ink 14 passes through the front end of the ejection electrode 4*a* through an ink incoming port 2 from a not-illustrated ink tank and returns to the ink tank from an ink outgoing port 5. Toner particles in the ink 14 are electrified to be positive and the counter electrode 6 is grounded. The toner particles in the ink 14 fly toward the counter electrode 6 when a positive voltage is applied by the ejection electrodes 4*a* and attach to the recording medium 8. Thereby, the toner particles are slowly decreased from the ink 14 whenever printing is performed.

The recording medium 8 is moved from the upper side to the lower side in FIG. 2 (sub-scanning direction) by a not-illustrated mechanism. However, the recording head 3 moves in the horizontal direction (main-scanning direction). Thereby, it is possible to attach toner particles to the entire surface of the recording medium 8.

The ink concentration detection device 9 is realized by a surface electrical potential sensor. The control unit 10 has the concentration decision circuit 11 for deciding the electrical potential detected by the toner concentration detection device 9 nearby the ejection opening 7. The voltage control circuit 12 for controlling a pulse voltage 12*a* output to be applied to the ejection electrodes 4*a* in accordance with a decision voltage 11*a* by the concentration decision circuit 11. The voltage applying circuit 13 for applying the pulse voltage 12*a* to the ejection electrodes 4*a* in accordance with the pulse voltage 12*a* of the voltage control circuit 12.

The concentration decision circuit 11 outputs two values of the decision voltage 11*a* lower and higher than a reference potential by comparing the potential detected by the toner concentration detection device 9 nearby the ejection opening 7 with the reference potential.

Figures 3, 4:
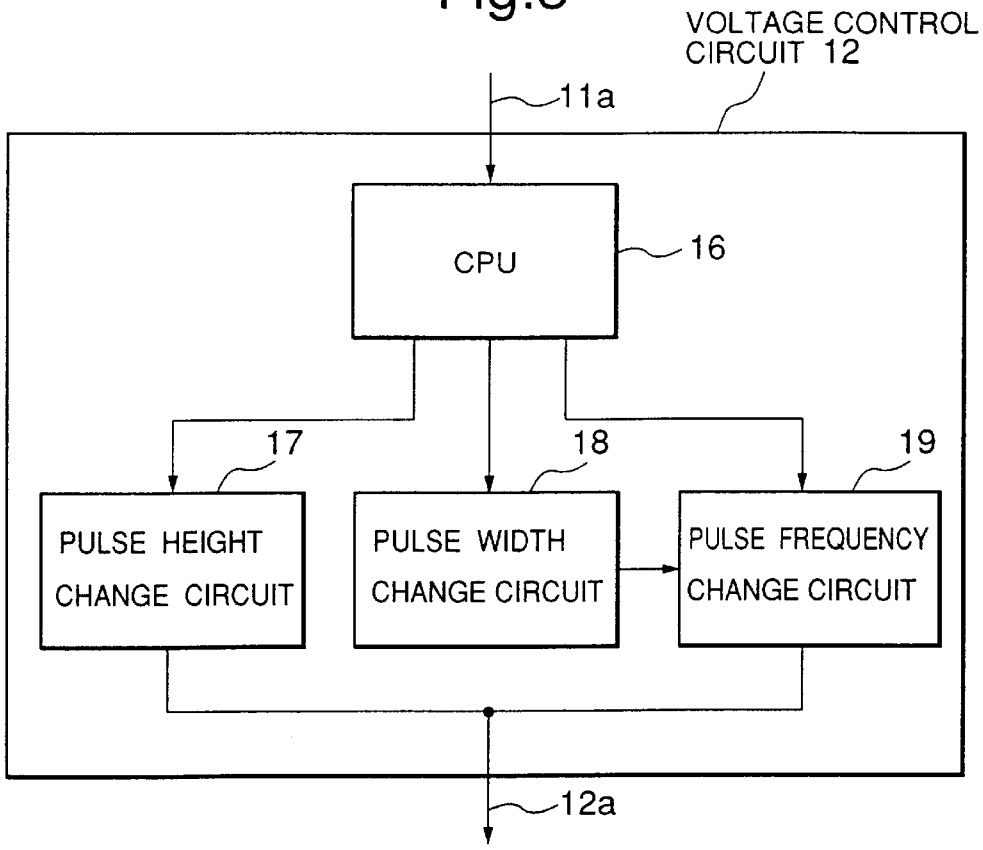
FIG. 3 is a block diagram showing a voltage control section of the embodiment of the present invention.
FIG. 4 is a ROM table showing inner part of a CPU of the embodiment in FIG. 3.

FIG. 3 is a block diagram showing the voltage control circuit 12. The voltage control circuit 12 has a CPU 16 for performing control in accordance with the decision voltage 11*a* of the concentration decision circuit 11. A pulse height change circuit 17 for changing the pulse voltage 12*a* to be applied to the ejection electrodes 4*a*. A pulse width change circuit 18 for changing pulse widths of the pulse voltage 12*a* to be applied to the ejection electrodes 4*a*, and a pulse frequency change circuit 19 for changing pulse intervals of the pulse voltage 12*a* to be applied to the ejection electrodes 4*a*.

The voltage applying circuit 13 in FIG. 2 is a driver for controlling a voltage to be applied to the ejection electrodes 4*a* in accordance with a printing information 15 transmitted from a high-order unit and the pulse voltage 12*a* output from the voltage control circuit 12.

Figure 8:
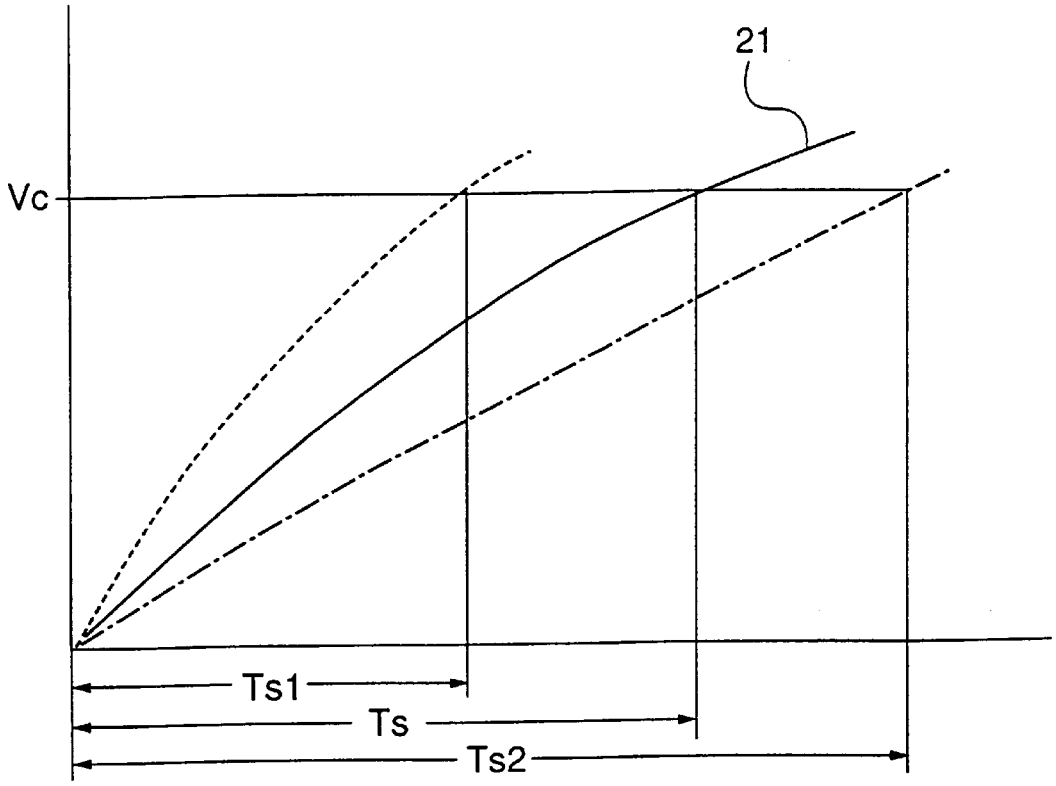
FIG. 8 is an illustration showing that times until reaching a potential high enough for toner particles at the ejection opening of a recording head to be ejected are changed due to ink characteristics.

FIG. 8 is an illustration for showing that times until reaching a potential high enough for the toner particles of the ejection opening 7 of the recording head 3 to be ejected are changed due to ink characteristics such as ink viscousity, electrical potential for ejection e.t.c. As shown in FIG. 8, when the characteristics of the ink 14 are changed due to the toner concentration in the ink 14 or an environmental condition such as temparature, humidity e.t.c., times until reaching a potential necessary for toner to fly from the ejection opening 7 are changed. The continuous line in FIG. 8 shows the state of a toner particle potential 21 of the ejection opening 7 when applying a voltage to the ejection electrodes 4*a*. That is, FIG. 8 shows that, when the toner particle potential 21 exceeds an ejection potential Vc at which toner particles can be ejected, toner particles fly toward the counter electrode 6. When the toner concentration is low, the time until reaching the potential meeting ejection is lengthened up to Ts2 as shown by the chain line. When the toner concentration is high, the time until reaching the potential meeting ejection is shortened up to Ts1.

Operation of this embodiment is described below by referring to FIGS. 1, 2, 3, 4 and 8. In the case of the ejection, the pulse voltage 12*a* determined by a value already set by the control means 10 is applied by the voltage applying circuit 13. The toner concentration detection device 9 detects the potential nearby the ejection opening 7 when a voltage is applied to the ejection electrodes 4*a* by the voltage applying circuit 13. The potential detected by the toner concentration detection device 9 is compared with the reference potential to decide whether the potential is higher or lower than the reference potential by the concentration decision section 11. The reference potential is set to a potential for deciding whether the potential is high enough for toner particles to be ejected. A decided result is input to the voltage control circuit 12.

When the decision result by the concentration decision circuit 11 is lower than the reference potential, that is, when the result does not reach a potential high enough for toner particles to be ejected, a pulse voltage having a time longer than a set value is set by the pulse width change circuit 18 (in FIG. 3) and applied to the ejection electrodes 4*a* from the voltage applying circuit 13. Then, the potential of the ejection opening 7 at this time is detected by the toner concentration detection device 9 and the concentration decision section 11 decides whether the detected potential is higher or lower than the reference potential. When the decision result is lower than the reference potential, the section 11 sets the pulse voltage to a longer pulse time and makes decision in the same manner as the above. According to the above procedure, pulse times to be applied to the ejection electrodes 4*a* are changed by the pulse width change circuit 18 until the potential of the ejection opening 7 becomes higher than the reference potential of the concentration decision circuit 11. As a result, when a decision result is higher than the reference potential, the pulse time at this time is used as the time for applying a pulse voltage to the ejection electrodes 4*a* for actually printing the recording medium 8. As a result, when printing cannot be performed by the pulse driving frequency having been used so far, cycles for supplying a voltage to the ejection for printing the recording medium 8 by the pulse frequency change circuit 19 are also changed. Thereby, stable printing can be performed any time even if ink characteristics are changed.

Then, when the decision result by the concentration decision circuit 11 is higher than the reference potential, a pulse voltage with a time shorter than a set value is set by the pulse width change circuit 18 to apply the pulse voltage to the ejection electrodes 4*a* by the voltage applying circuit 13. Then, the potential of the ejection opening 7 at this time is detected by the toner concentration detection device 9 and the concentration decision section 11 decides whether the detected potential is higher than the reference potential. When the decision result is higher than the reference potential, the time for applying a voltage to the ejection is shortened until the decision result by the concentration decision circuit 11 becomes lower than the reference potential. When the decision result by the concentration decision circuit 11 becomes lower than the reference voltage, applying of the voltage to the ejection electrodes 4*a* is stopped to use the applying time immediately before the decision result becomes lower than the reference voltage as the time for applying a voltage to the ejection electrodes 4*a* for actually printing the recording medium 8. Driving frequencies are also changed by the pulse frequency change circuit 19 according to necessity.

Thereby, printing can be performed at an optimum driving frequency and stable printing quality is obtained and moreover, it is possible to increase the printing speed.

Moreover, it is possible to obtain the same advantage as the above by changing pulse voltages by the pulse height change circuit 17 instead of changing pulse widths by the pulse width change circuit 18.

These applying times are set whenever a power supply is turned on at the stop position of a recording head 3 out of a recording range or printing is started.

Another embodiment of the concentration decision circuit 11 makes it possible to output the potential detected by the toner concentration detection device 9 nearby the ejection opening 7 as a plurality of values by converting the potential from analog to digital values. The above-described embodiment decides the potential of the ejection opening 7 at two levels that the potential is lower and higher than the reference potential. However, this embodiment makes it possible to show a potential value of the ejection opening 7 in a certain range by one of 16 values obtained by using, for example, a 4-bit A-D converter and thereby, dividing the potential into 16 values. The potential of the ejection opening 7 and a proper voltage applying time corresponding to the potential and to be supplied to the ejection electrodes 4*a* are previously stored in a ROM table 20 as shown in FIG. 4 in the CPU 16 (in FIG. 3) of the voltage control circuit 12 to supply a corresponding applying time out of 16 divided values by referring to a detected potential in the ROM table 20. As a result, it is possible to obtain a proper voltage-applying time in a short time compared to the case of the above-described embodiment in which an optimum value is found by changing time widths or pulse heights one level by one level.

In this embodiment of the recording head 3 by a block diagram, the recording head 3 as shown in FIG. 1 has a plurality of ejection electrodes 4*a*. In the case of this embodiment, a memory is provided for a CPU 16 in a voltage control circuit 12 and an optimum voltage applying time for each ejection electrodes 4*a* or each group of several ejection electrodes 4*a* is obtained by the same procedure as the case of the above-described embodiment and stored in the memory. Moreover, the stored time is used as the voltage applying time when actually printing the recording medium 8. Thereby, even when a plurality of ejection electrodes 4*a* are arranged, fluctuation of ejection openings 7 is also considered and stable printing is realized.

Figure 5:
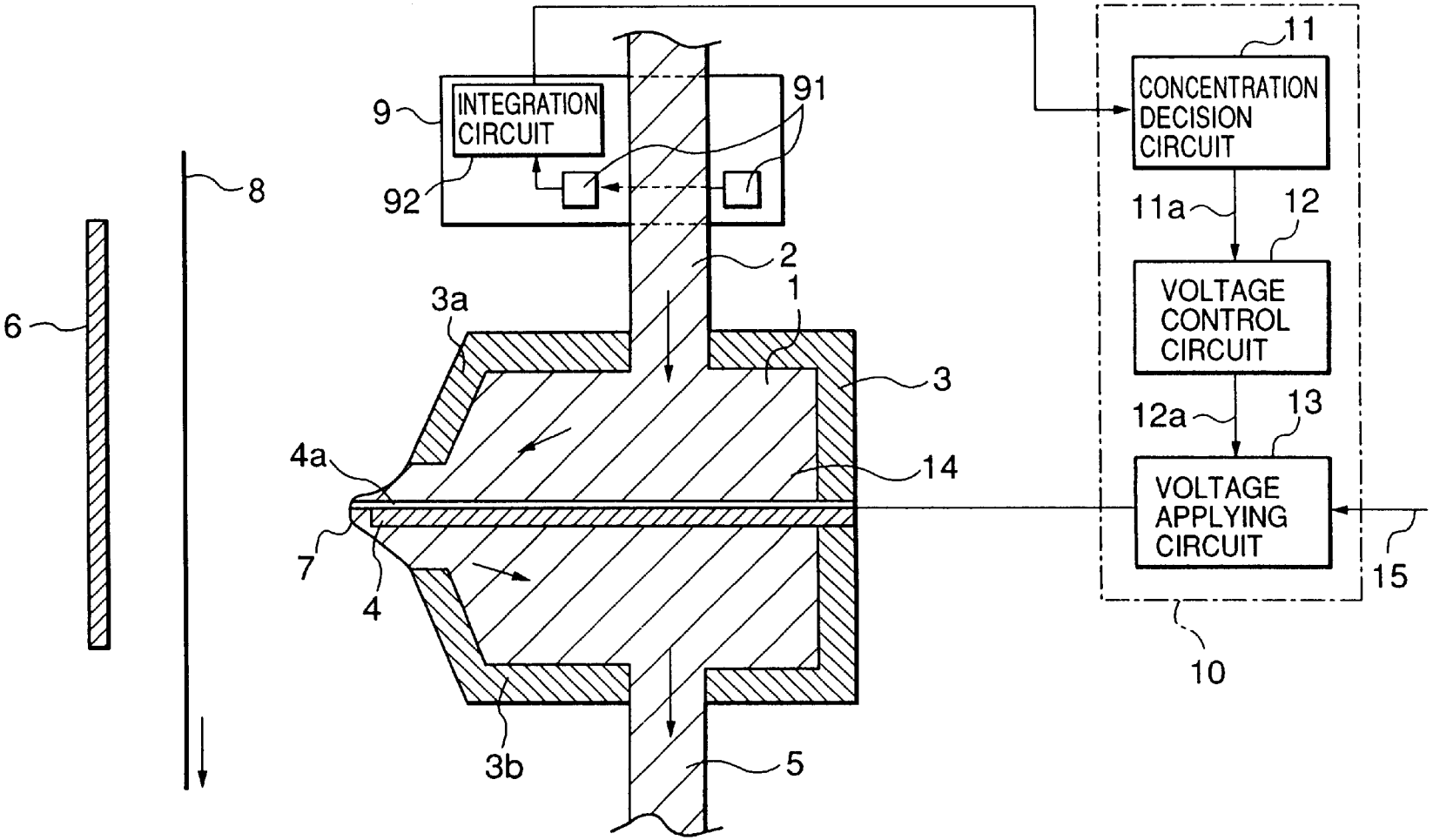
FIG. 5 is a block diagram and a sectional view showing another embodiment of the present invention.

FIG. 5 is a block diagram showing another embodiment of the present invention. When referring to FIG. 2, the electrostatic ink-jet recording apparatus of this embodiment has a recording head 3 provided with an ink chamber 1 storing an ink 14 containing electrified toner particles and having an ejection opening 7 at one end and an ejection electrodes 4*a* for ejecting the toner particles from the ejection opening 7. A counter electrode 6 faces with the ejection opening 7 through a recording medium 8. A toner concentration detection device 9 for measuring the toner particle concentration in the ink 14. The control unit 10 is provided with a concentration decision circuit 11 for deciding a measured toner particle concentration. A voltage control circuit 12 for controlling a pulse voltage output to be applied to the ejection electrodes 4*a* in accordance with the decision by the concentration decision circuit 11. A voltage applying circuit 13 is provided for applying a voltage to the ejection electrodes 4*a* in accordance with the output of the voltage control circuit 12.

The toner concentration detection device 9, as illustrated, measures an amount of toner for a certain time by a transmission-type optical sensor 91 and an integration circuit 92. The concentration decision section 11 decides a toner particle concentration measured by the toner concentration detection unit 9. The voltage control section 12 controls a pulse voltage 12*a* output 12*a* to be applied to the ejection electrodes 4*a* in accordance with a decision voltage 11*a* by the concentration decision circuit 11. The voltage applying circuit 13 for applying the pulse voltage 12*a* to the ejection electrodes 4*a* in accordance with the pulse voltage 12*a* of the voltage control circuit 12.

Operations of this embodiment are described below by referring to FIGS. 1, 3, 4, 5 and 8. It is assumed that the pulse voltage 12*a* determined by a value already set by the control circuit 10 is presently applied to the ejection electrodes 4*a*. The toner concentration detection device 9 time-measures an amount of toner by a transmission-type optical sensor 91 and an integration circuit 92. The concentration measured by the toner concentration detection device 9 is shown by one of 16 divided values by using, for example, a 4-bit A-D converter of the concentration decision circuit 11.

The relation between the toner particle concentration in the ink 14 and the time required to eject toner particles from the ejection opening 7 is previously stored in the ROM table 20 as shown in FIG. 4 in the voltage control circuit 12. For example, by using the 4-bit A-D converter, voltage applying times of 16 levels are specified. A toner concentration is detected by the toner concentration detection device 9 before starting printing to convert the concentration into a digital value by the concentration decision circuit 11. Pulse widths are changed by the pulse width change circuit 18 correspondingly to the digital value and a voltage is applied to the ejection electrodes 4*a* by the voltage applying circuit 13.

As a result, printing cannot be performed by the driving frequency having been used so far or, when further acceleration is possible, cycles for applying a pulse voltage to the ejection electrodes 4*a* to print the recording medium 8 are changed by the pulse frequency change circuit 19.

Thereby, even if ink characteristics are changed, stable printing can be performed any time. Moreover, printing can be performed at an optimum frequency and the printing speed can be increased.

Furthermore, it is possible to obtain the same advantage as the above by changing pulse voltages by the pulse height change circuit 17 instead of changing pulse widths by the pulse width change circuit 18.

Setting of these applying times is performed at the stop position of the recording head 3 out of a recording range whenever a power supply is turned on or printing is started.

Figure 6:
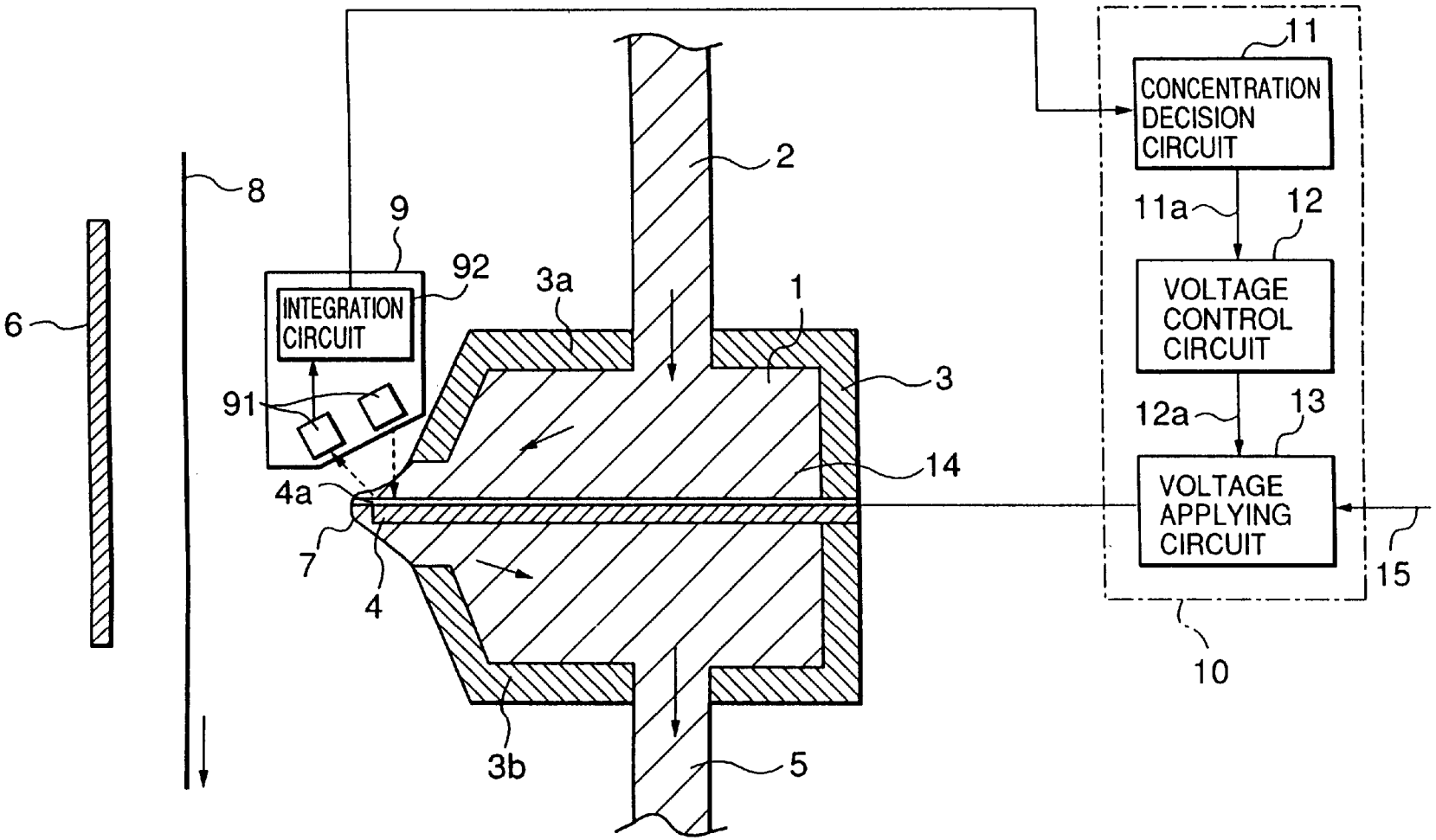
FIG. 6 is a block diagram and a sectional view showing still another embodiment of the present invention.
Figure 7:
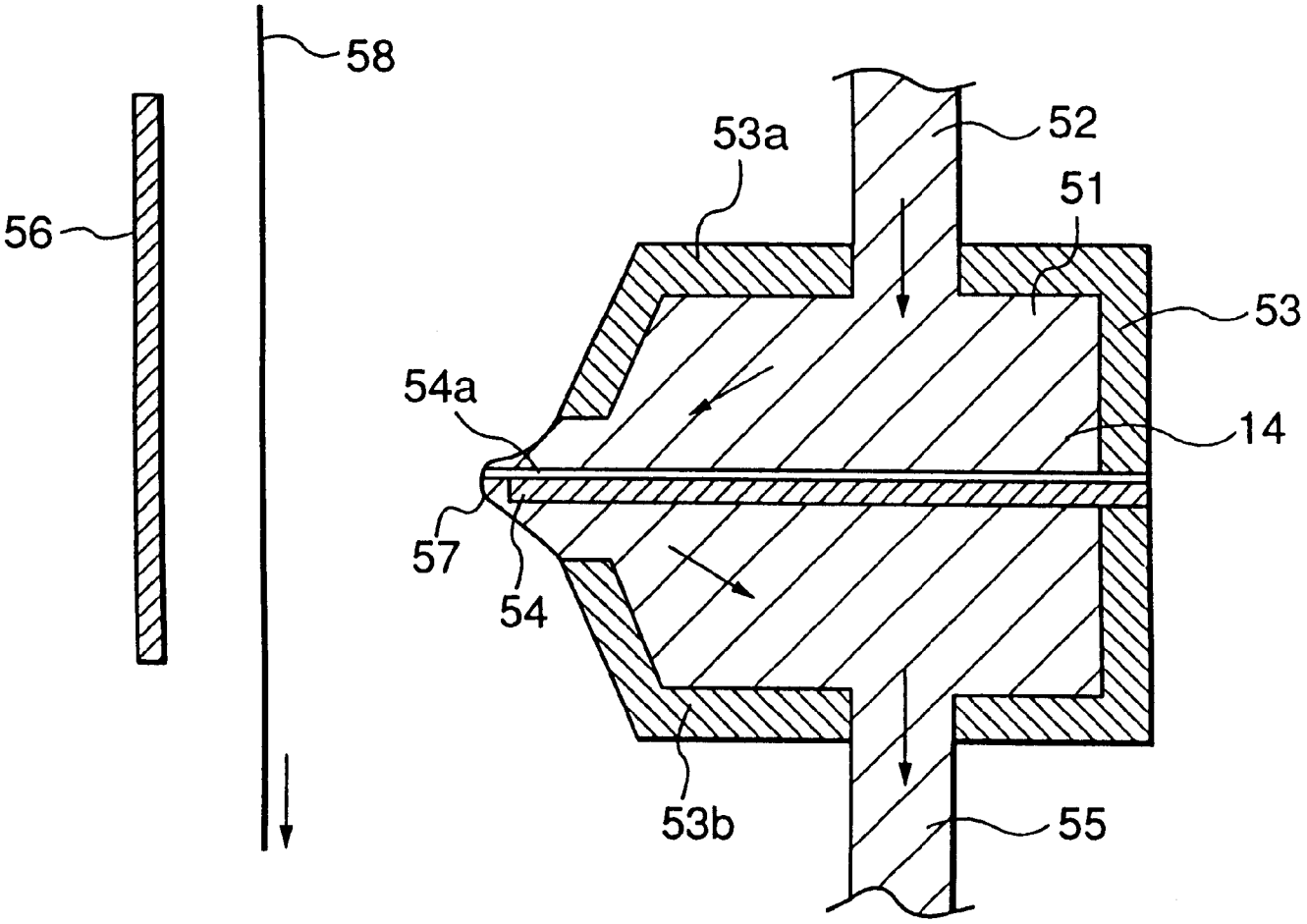
FIG. 7 is a sectional view showing a conventional example.

FIG. 6 is a block diagram showing still another embodiment of the present invention. This embodiment is a variation of foregoing embodiment as shown in FIG. 5. In this embodiment, a toner concentration detection device 9 is disposed toward an ejection opening 7 and constructed by a reflection-type optical sensor 91 and an integration circuit 92. This composition enables to detect toner concentration on ejection opening 7 by intensity of reflection light.

As described above, an electrostatic ink-jet recording apparatus of the present invention makes it possible to obtain an almost constant dot diameter and a stable printing quality independently of the change of ink characteristics by measuring a toner potential of an ejection opening, determining a time until reaching a potential high enough for toner particles to be ejected in accordance with the measurement result, and applying a voltage to ejection electrodes for a proper time.

Moreover, a recording head having a plurality of ejection electrodes makes it possible to obtain an almost constant dot diameter and a stable printing quality independently of the change of ink characteristics by measuring the toner potential of an ejection opening every ejection electrode or every several groups, determining a time until reaching a potential high enough for toner particles to be ejected in accordance with the measurement result, and applying a voltage to the ejection electrodes for a proper time.

Furthermore, the toner concentration in ink is measured, a time until reaching a potential high enough for toner particles to be ejected is determined in accordance with the measurement result, and a time for applying a voltage to ejection electrodes is determined. Thus, an almost constant dot diameter and a stable printing quality can be obtained independently of the change of ink characteristics.

What is claimed is:

1. An electrostatic ink-jet recording apparatus, comprising:

an ink chamber storing ink containing electrified toner particles and having an ejection opening at one end;

an ejection electrode disposed at said ejection opening for ejecting said toner particles from said ejection opening;

a counter electrode facing said ejection opening and said ejection electrode through a recording medium;

a toner concentration detector which measures a toner particle concentration in said ink at a point of said ink chamber; and a control circuit which controls an ejection voltage to be applied to said ejection electrode, said control circuit including:

(a) a comparison circuit which compares a voltage corresponding to said toner particle concentration detected by said toner concentration detector with a reference voltage;

(b) a pulse width changing circuit which changes a pulse width of said ejection voltage based on a comparison result output by said comparison circuit.

2. The electrostatic ink-jet recording apparatus according to claim 1, wherein said toner concentration detector has a potential detector for detecting electrical potential of said ejection opening.

3. The electrostatic ink-jet recording apparatus according to claim 2, wherein said potential detector is disposed nearby said ejection electrode.

4. The electrostatic ink-jet recording apparatus according to claim 1, wherein said toner concentration detector has a light intensity detector for detecting light intensity of penetrated light by said ink.

5. The electrostatic ink-jet recording apparatus according to claim 4, wherein said light intensity detector detects said light intensity of said penetrated light by said ink in an incoming port of said ink chamber.

6. The electrostatic ink-jet recording apparatus according to claim 1, wherein said toner concentration detector has a light intensity detector for detecting light intensity of reflected light by said ink at the point of said ink chamber.

7. The electrostatic ink-jet recording apparatus according to claim 6, wherein said light intensity detector is disposed toward said ejection opening.

8. The electrostatic ink-jet recording apparatus according to claim 1, wherein said control circuit includes:

a processor which generates a test ejection voltage based on an output of said comparison circuit, said processor controlling said pulse width changing circuit to alter a pulse width of said test ejection voltage when said toner particle concentration detected by said toner concentration detector is different from a set value, said control circuit applying said test ejection voltage to said ejection electrode, and wherein said toner concentration detector detects a second toner particle concentration as a result of said test ejection voltage being applied to said ejection electrode, said comparison circuit comparing a voltage corresponding to said second toner particle concentration to said reference voltage, and said processor generating a second test ejection voltage with a further altered pulse width, said control circuit inputting said second test ejection voltage into said ejection electrode for actual printing if said second toner particle concentration is more than said set value, or generating additional test ejection signals with further-altered pulse widths until said reference value is matched.

9. The electrostatic ink-jet recording apparatus according to claim 1, wherein said control circuit includes:

a pulse frequency changing circuit which changes a frequency at which ejection voltages are applied to said ejection electrode for printing, said pulse frequency changing circuit changing said frequency based on the pulse width changed by said pulse width changing circuit.

10. An electrostatic ink-jet recording apparatus, comprising:

an ink chamber storing ink containing electrified toner particles and having an ejection opening at one end;

an ejection electrode disposed at said ejection opening for ejecting said toner particles from said ejection opening;

a counter electrode facing said ejection opening and said ejection electrode through a recording medium;

a toner concentration detector which measures a toner particle concentration in said ink at a point of said ink chamber; and a control circuit which controls an ejection voltage to be applied to said ejection electrode said control circuit including:

a concentration decision circuit for deciding a detected electrical potential on a basis of an output from said toner concentration detector;

a voltage control circuit for controlling said ejection voltage to be applied to said ejection electrode in accordance with a decision by said concentration decision circuit, said voltage control circuit including a pulse width changing circuit which changes a pulse width of said ejection voltage based on the decision by said concentration decision circuit; and a voltage applying circuit for applying said ejection voltage controlled by said voltage control means to said ejection electrode in accordance with printing information.

11. The electrostatic ink-jet recording apparatus according to claim 10, wherein said concentration decision circuit outputs two values higher and lower than a reference potential by comparing a detected concentration with said reference potential.

12. The electrostatic ink-jet recording apparatus according to claim 10, wherein said concentration decision circuit outputs a concentration value as a digital value corresponding to one of a plurality of quantized levels, said concentration circuit outputting said digital value by performing an analog-to-digital conversion of said detected potential.

13. The electrostatic ink-jet recording apparatus according to claim 12, wherein said voltage control circuit includes a ROM table for storing at least one of predetermined pulse height, pulse width, and pulse frequency values of a pulse voltage to be applied to said ejection electrode, said predetermined pulse height, pulse width, and pulse frequency values corresponding to respective ones of said quantized levels, and wherein said voltage control circuit reads an optimum value of said pulse voltage from said ROM table in accordance with said digital value output from said concentration decision circuit and outputs said value.

14. The electrostatic ink-jet recording apparatus according to claim 10, wherein said voltage control means changes and outputs pulse heights, pulse widths, and pulse frequencies of a pulse voltage to be applied to said ejection electrode in accordance with said output of said concentration decision means.

* * * * *